US009362611B2

(12) United States Patent
Park et al.

(10) Patent No.: US 9,362,611 B2
(45) Date of Patent: Jun. 7, 2016

(54) INTERNAL ANTENNA OF MOBILE TERMINAL

(71) Applicant: Samsung Electronics Co., Ltd., Gyeonggi-do (KR)

(72) Inventors: Jeongwan Park, Gyeongsangbuk-do (KR); Byungchan Jang, Gyeongsangbuk-do (KR); Sukho Kim, Gyeonggi-do (KR); Seunghwan Kim, Seoul (KR); Joonho Byun, Gyeonggi-do (KR)

(73) Assignee: Samsung Electronics Co., Ltd., Yeongtong-gu, Suwon-si, Gyeonggi-do (KR)

( * ) Notice: Subject to any disclaimer, the term of this patent is extended or adjusted under 35 U.S.C. 154(b) by 328 days.

(21) Appl. No.: 13/954,256

(22) Filed: Jul. 30, 2013

(65) Prior Publication Data

US 2014/0043192 A1 Feb. 13, 2014

(30) Foreign Application Priority Data

Aug. 13, 2012 (KR) ..... 10-2012-0088376

(51) Int. Cl.

| | |
|---|---|
| ***H01Q 1/24*** | (2006.01) |
| ***H01Q 1/08*** | (2006.01) |
| ***H01Q 1/38*** | (2006.01) |

(52) U.S. Cl.

CPC ..... *H01Q 1/243* (2013.01); *H01Q 1/088* (2013.01); *H01Q 1/38* (2013.01)

(58) Field of Classification Search

CPC ..... H01Q 1/243; H01Q 1/088; H01Q 1/38
USPC ..... 343/702, 893
See application file for complete search history.

(56) References Cited

U.S. PATENT DOCUMENTS

| | | | | |
|---|---|---|---|---|
| 6,219,230 | B1 * | 4/2001 | Cho | G06F 1/1616 16/342 |
| 2009/0213029 | A1 | 8/2009 | Baliarda et al. | |
| 2011/0215971 | A1 * | 9/2011 | Rao | H01Q 1/243 343/702 |
| 2012/0046002 | A1 * | 2/2012 | Hill | H01Q 1/243 455/73 |

FOREIGN PATENT DOCUMENTS

| | | | |
|---|---|---|---|
| EP | 2 182 579 | A1 | 5/2010 |
| WO | 02/31921 | A2 | 4/2002 |
| WO | 2011/105381 | A1 | 9/2011 |

* cited by examiner

*Primary Examiner* — Hoanganh Le
(74) *Attorney, Agent, or Firm* — Cha & Reiter, LLC

(57) ABSTRACT

An antenna of a mobile includes at least two internal antennas and a printed circuit board disposed between a front cover and a rear cover. The printed circuit board includes at least one first antenna mounted on an upper surface and the printed circuit board having at least one fastening opening therein. A second antenna is mounted in an upper portion of a side surface of the printed circuit board and included a protruded portion of one end protruded from a body and in which the protruded portion is fastened to the fastening opening to be fastened to a side surface of the printed circuit board and the mobile terminal can be produced having a reduced thickness.

18 Claims, 6 Drawing Sheets

INTERNAL ANTENNA OF MOBILE TERMINAL

CLAIM OF PRIORITY

This application claims the benefit of priority under 35 U.S.C. §119(a) from a Korean patent application filed on Aug. 13, 2012 in the Korean Intellectual Property Office and assigned Serial No. 10-2012-0088376, the entire disclosure of which is hereby incorporated by reference in its entirety.

BACKGROUND

1. Field of the Invention

The present disclosure relates to an antenna of a mobile terminal. More particularly, the present invention relates to an internal antenna of a mobile terminal that can support a multi-band and a multi-function operation and that can secure various radiator mounting space.

2. Description of the Related Art

Mobile terminals require antennas for wirelessly transmitting and receiving various types of communication. Nowadays, due to aesthetic design reasons of and performance, an internal antenna is widely used rather than a removable or an extendible external antenna. Entire antennas including an internal antenna/removable antenna require a radiator for transmitting and receiving a wireless signal. A radiator is generally used for transmitting and receiving an electronic signal (e.g., wireless communication signal) and is a device that radiates the electronic signal to space.

Mobile terminal are widely used for multimedia data communications as well as a basic communication functions. Conventionally, because an audio dedicated communication antenna and a data communication antenna are shared, even if one antenna radiator is used, there was no significant problem, regarding, for example, interference. Further, when a user holds the mobile terminal, an externally mounted antenna radiator is typically not covered by a user hand holding the terminal, and thus the antenna radiation performance does not greatly deteriorate as in the case of certain mobile terminals with internal antennas.

In addition, as multimedia-related data communication increases, there is increasing difficultly to provide a multiple service with one audio dedicated communication antenna, and thus an exclusive antenna for data communication becomes necessary. Further, mobile terminals often use both a 3G communication and a 4G long term evolution (LTE) communication method, each of which has a separate antenna, and thus the number of internal antennas mounted in the mobile terminal increases. Accordingly, the antenna allocation space in the mobile terminal becomes relatively reduced because of the separate 3G and 4G LTE internal antennas. Thus, as there is already difficulty in securing space for mounting two or more internal antennas in limited space, to add additional separate internal antennas for multi-media related communications and audio communications for each of the different protocols is not possible, or comes at a tradeoff of a larger-size portable terminal or the elimination of some of the functional modules that consumers have come to expect in such mobile terminals.

In addition, due to the increase of the number of antennas, when the user holds the mobile terminal during a call or when transmitting or receiving data, an antenna radiator is largely covered by the user' hand. Thus, a radiation performance of the antennas in the mobile terminal is greatly deteriorated, as compared with transmissions in a conventional external antenna. However, because an internal structure of the mobile terminal is technically arranged in a small area, it is quite difficult to freely change or rearrange the internal structure in contemplation of a user's grip of the mobile terminal. Therefore, there is difficulty in embodying a structure with an antenna pattern arranged to avoid interference by a user's hand.

SUMMARY

The present invention provides an internal antenna of a mobile terminal that can enable manufacture of a mobile terminal having a smaller overall thickness while securing various radiator mounting space and securing mounting space of other elements in the mobile terminal that can support a multi-band and a multi-function.

The present invention further provides an internal antenna of a mobile terminal that prevents the internal antenna from movement, shifting or separating by stably fixing the internal antenna.

The present invention further provides an internal antenna of a mobile terminal that improves an antenna performance by minimizing an adverse influence of a hand on the antenna radiator when a user holds the mobile terminal while transmitting or receiving.

In accordance with an exemplary aspect of the present invention, a mobile terminal having a plurality of internal antennas and a printed circuit board disposed between a front cover and a rear cover preferably includes: the printed circuit board has at least a first antenna of the plurality of internal antennas mounted on an upper surface and having at least one fastening opening therein; and a second internal antenna of the plurality of internal antennas mounted in an upper portion of a side surface of the printed circuit board and has a protruded portion of one end that protrudes from a body, and in which the protruded portion is fastened to the fastening opening and fastened to a side surface of the printed circuit board.

In accordance with another exemplary aspect of the present invention, an internal antenna of the plurality of internal antennas of a mobile terminal in which a printed circuit board having at least one fastening opening at the inside and having at least one first antenna arranged at an upper surface preferably includes: a second internal antenna for closely contacting with a side surface of the printed circuit board and having one end latched to an internal wall of the fastening opening and having a frequency band being higher than that of the first internal antenna.

BRIEF DESCRIPTION OF THE DRAWINGS

The above features and advantages of the present invention will become more apparent to a person of ordinary skill in the art from the following detailed description in conjunction with the accompanying drawings, in which.

DETAILED DESCRIPTION

Figure 1:
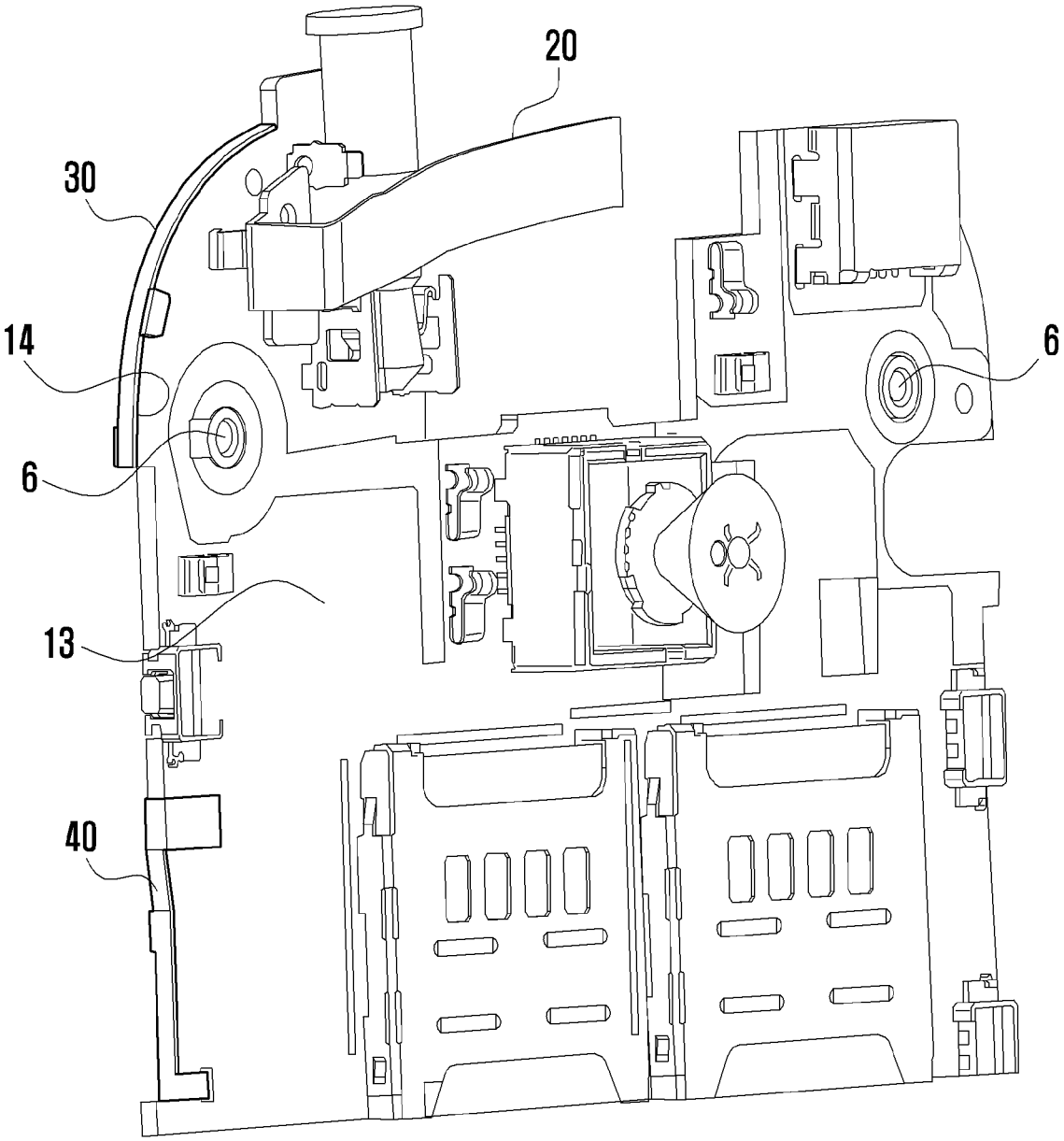
FIG. 1 is a perspective view illustrating an exemplary configuration of a printed circuit board according to an exemplary embodiment of the present invention.

Hereinafter, exemplary embodiments of the present invention are described in detail with reference to the accompanying drawings. The same reference numbers are used throughout the drawings to refer to the same or like parts. The views in the drawings are schematic views provided only for illustrative purposes, and are not intended to be to scale or correctly proportioned. Detailed descriptions of well-known functions and structures incorporated herein may be omitted to avoid obscuring appreciation of the subject matter of the present invention by a person of ordinary skill in the art that can be caused by lengthy descriptions of well-known functions and structures.

Hereinafter, prior to disclosing a detailed exemplary description of the present invention, a person of ordinary skill in the art should understand and appreciate that for convenience of description, the examples discussed herein regarding a mobile terminal according to an exemplary embodiment of the present invention describe the device as a mobile communication terminal. However, the appended claims are not in any way limited to only a mobile communication terminal. In other words, the mobile terminal according to an exemplary embodiment of the present invention can be embodied in any number of various devices and multimedia devices such as a mobile communication terminal, mobile phone, personal digital assistant (PDA), smart phone, international mobile telecommunication 2000 (IMT-2000) terminal, code division multiple access (CDMA) terminal, global system for mobile communication (GSM) terminal, universal mobile telecommunication service (UMTS) terminal, and digital broadcasting terminal, a tablet, a phablet, a mini-tablet and an application device thereof, just to name a few non-limiting possibilities.

Hereinafter, the term "monopole antenna" is an antenna of a form being grounded on one side, which is different from a "dipole antenna" using both electrodes. Such a monopole antenna may have an effect of a dipole antenna, as an image effect occurs in a grounded portion. In a mobile terminal, by forming a monopole type antenna using the ground of the terminal, an antenna length may be reduced.

A "plannar inverted-F antenna (PIFA)" refers to an antenna in which an electric signal supplied from a printed circuit board is transferred to a radiator through a power supply line, and in which an electric signal transferred to the radiator receives an electric wave of air or radiates an electric wave to air using a circuit transmission line formed by returning to the printed circuit board through a ground line.

Figure 2:
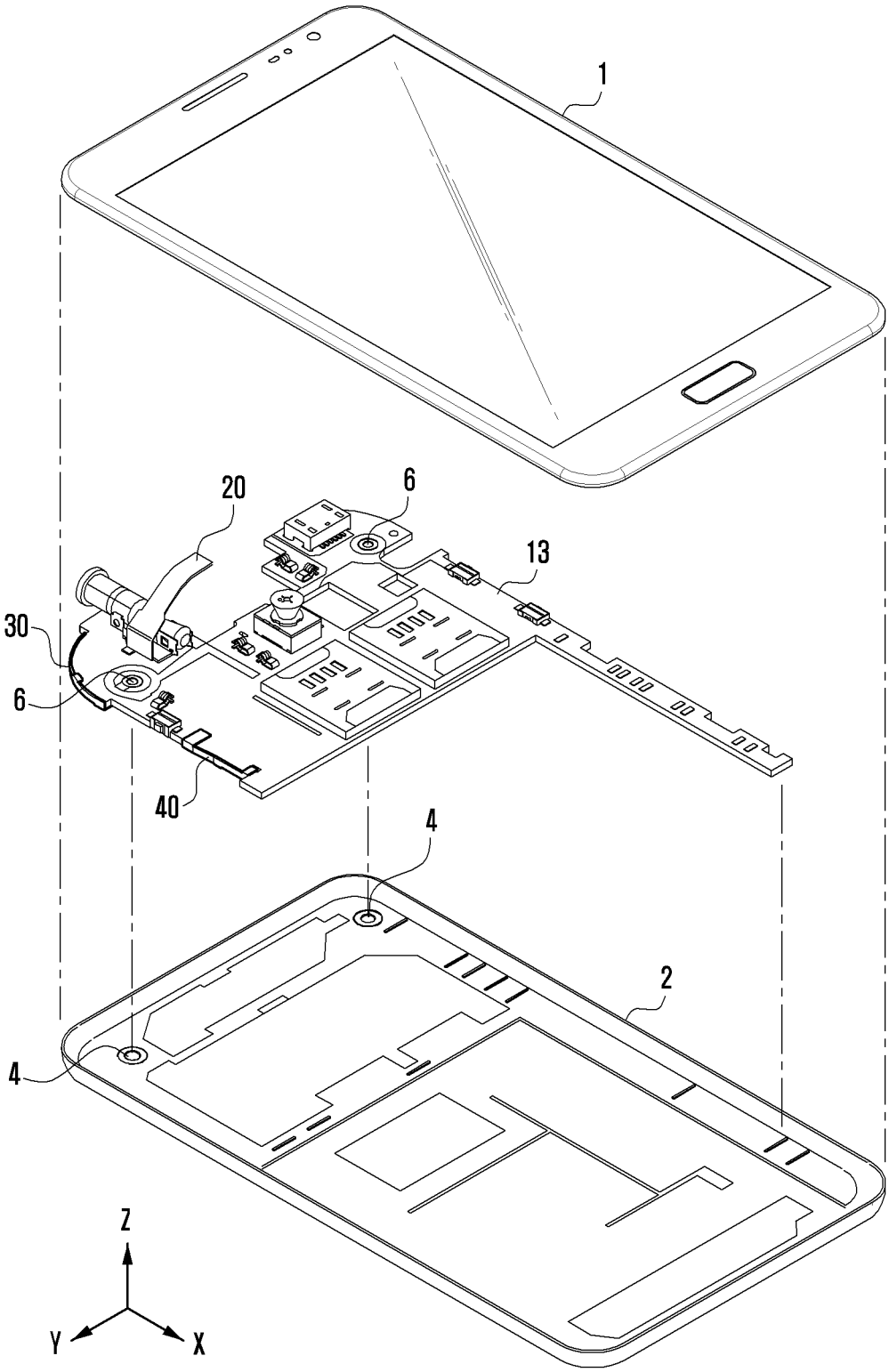
FIG. 2 is an exploded view illustrating various components of an exemplary configuration of a mobile terminal according to an exemplary embodiment of the present invention.

FIG. 1 is a perspective view illustrating exemplary configuration of a printed circuit board according to an exemplary embodiment of the present invention, and FIG. 2 is an exploded perspective view illustrating an exemplary configuration of a mobile terminal according to an exemplary embodiment of the present invention.

Referring now to FIGS. 1 and 2, the mobile terminal according to the present example includes a front cover 1, a rear cover 2, a printed circuit board 13, and a plurality of antennas 20, 30, and 40.

The printed circuit board 13 is arranged between the front cover 1 and the rear cover 2, in which the front cover 1 covers a front surface of the mobile terminal and includes a display device, and in which the rear cover 2 covers a rear surface of the mobile terminal and protects internal elements.

The printed circuit board 13 comprises a thin plate for mounting electronic components such as a camera, SD memory, and subscriber identification module (SIM) card formed with an integrated circuit (IC), resistor, capacitor, and switch and may include receiving modules for forming a signal received through the plurality of antennas 20, 30, and 40 and a wiring for electrically connecting the mounted electronic components and elements into an image so that a user to visually view the signal and for outputting the image to a display device.

The printed circuit board 13 preferably includes a boss hole 6 for fastening the front cover 1 and the rear cover 2, and the boss hole 6 may be fastened to boss holes 4 of the front cover 1 and the rear cover 2 through a coupling member (not shown), and a typical coupling member (not shown) is generally a screw, however the coupling member is not limited thereto and other coupling members may be used instead of the screw, including but not in any way limited to snaps, pins, press fit, interlocking tongues, etc. just to name a few of the many non-limiting possibilities.

In general, as a main circuit board of the mobile terminal, the printed circuit board 13 can be disposed (i.e. positioned, arranged) at an upper end portion of the mobile terminal, and as a sub-circuit board, a sub-printed circuit board may be disposed at a lower end portion of the mobile terminal, but a printed circuit board of the mobile terminal according to the present example the printed circuit board 13 is disposed at the upper end portion.

The plurality of internal antennas 20, 30, and 40 each radiate a signal to transmit to air when a communication function of the mobile terminal is activated and the internal antennas receive a signal radiated to air from another source.

The plurality of internal antennas 20, 30, and 40 may be provided within the inside (i.e. an interior) of the mobile terminal and in an example one antenna can having a frequency band of 1.56 GHz or more so the antenna can be suited for as Bluetooth (BT), a global positioning system (GPS), and Wi-Fi, and a main antenna and a diversity antenna can be used to perform communications of global system for mobile communications (GSM), code division multiple access (CDMA), and wideband code division multiple access (WCDMA).

The plurality of internal antennas 20, 30, and 40 may operate as a single band antenna having a form of a monopole antenna to which a ground line is not connected, or and a single band antenna having a form of a PIFA antenna to which a ground line is connected at a periphery of a power supply line. When the plurality of antennas 20, 30, and 40 have a PIFA antenna form, even if the plurality of antennas 20, 30, and 40 are used in the same frequency band, an antenna size can be further reduced.

With continued reference to FIG. 2, more particularly, the plurality of internal antennas 20, 30, and 40 according to the present exemplary embodiment can be classified into a first antenna 20 mounted at an upper surface of the printed circuit board 13, a second antenna 30 and a third internal antenna 40 that are both mounted at a side surface of the printed circuit board 13.

As shown in FIGS. 1 and 2, the first antenna 20 is disposed at an upper surface of the printed circuit board 13 and is defined as an antenna representing a plurality of antennas separately disposed by a predetermined gap as a range that does not have an influence on an antenna gain or a signal between adjacent antennas. The first antenna 20 may be mounted, for example, in fusion-bonding and in-mold type antenna structure on an upper surface of the printed circuit board.

The second and third internal antennas 30 and 40 may comprise a plurality of antennas separately disposed by a predetermined gap at a side surface of the printed circuit board 13.

More specifically, the first internal antenna 20 and the second and third internal antennas 30 and 40 may be previously distinguished by comparison of a relative antenna length embodied according to a frequency band. In general, as a frequency band is lower, a wavelength is extended and thus an antenna length is formed to be relatively longer, and as a frequency band is higher, a wavelength is shortened and thus an antenna length is formed to be relatively shorter.

In consideration of a correlation of a frequency band and an antenna length, and with continued reference to FIGS. 1 and 2 in the mobile terminal according to the present exemplary embodiment, an antenna having a relatively long length due to a low frequency band is distinguished as the first antenna 20 that disposes on an upper surface of the printed circuit board 13, and an antennas having a relatively shorter length due to a high frequency band is distinguished as the second and third internal antennas 30 and 40 mounted at a side surface of the printed circuit board 13.

For example, it is assumed that at the inside of the mobile terminal, an internal antenna having a frequency band of 1.56 GHz or more, such as a BT antenna, a GPS antenna, or a Wi-Fi antenna, and a main antenna and a diversity antenna that performs communication of GSM, CDMA, and WCDMA should be mounted (exceptionally, because a DMB antenna (not shown) generally uses a reception type antenna because DMB modules receive DMB data, but may not transmit DMB data, so the DMB antenna may be excluded from an antenna mounted in the mobile terminal according to the present exemplary embodiment).

Figure 3:
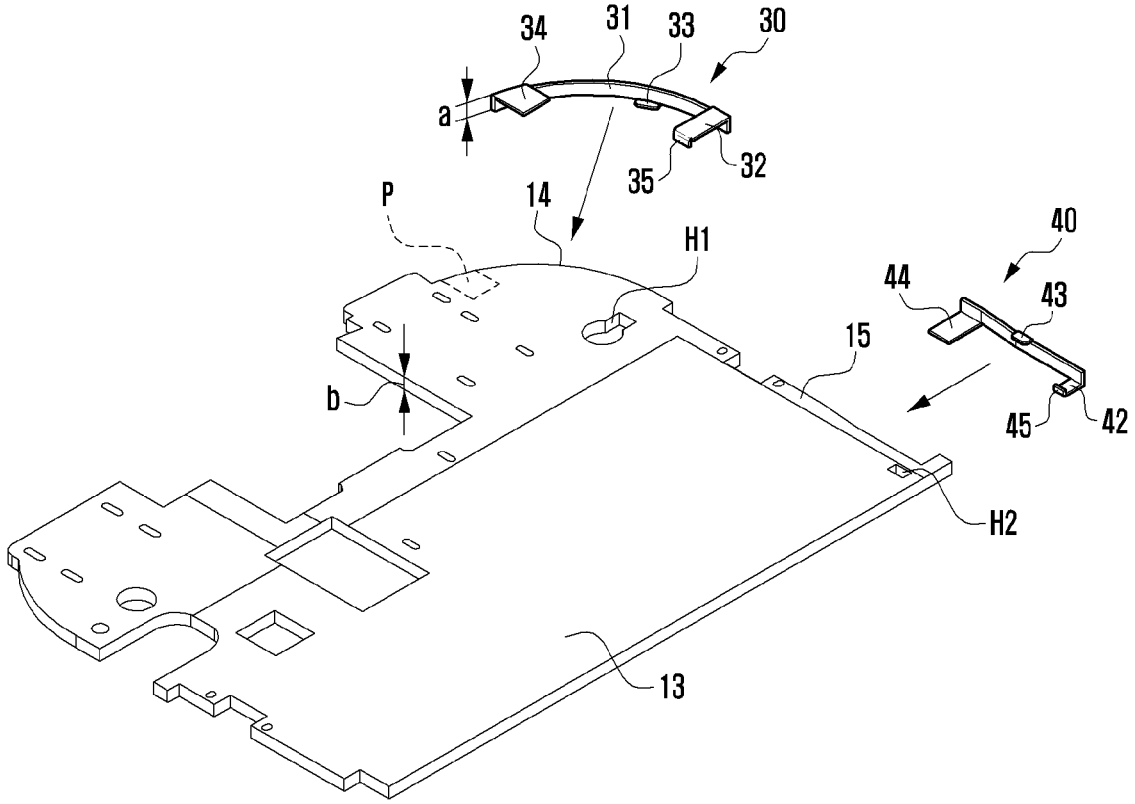
FIG. 3 is a perspective view illustrating mounting of an antenna of the mobile terminal of FIG. 2.

In this case, the mobile terminal according to the present exemplary embodiment can mount a GSM antenna, CDMA antenna, WCDMA antenna, or diversity antenna having a frequency band of 1.56 GHz or fewer as the first antenna 20 at an upper surface of the printed circuit board 13 and can mount a BT antenna, GPS antenna, or Wi-Fi antenna having a frequency band of 1.56 GHz or more as the second and third internal antennas 30 and 40 mounted at side surfaces 14 and 15 (FIG. 3) of the printed circuit board, based on a frequency of 1.56 GHz. In other words, as shown in FIG. 3, a high band antenna may be mounted at the side surfaces 14 and 15 of the printed circuit board, and as shown in FIG. 2 a low band antenna may be mounted on an upper surface of the printed circuit board.

The reason for selecting the mounting of an antenna having a relatively high frequency band at the side surface 14 of the printed circuit board 13 is that a length and an area that is used to mount an antenna at the side surface 14 of the printed circuit board 13 is more limited in size than a length and an area of the upper surface of the printed circuit board 13 in which an antenna can be mounted.

Therefore, an artisan understand why it is preferable to dispose a high band antenna requiring a relatively smaller mounting area at the side surface 14 of the printed circuit board 13.

As described above, because at least one high band antenna may be mounted at the side surface 14 of the printed circuit board 13, there is additional space left to mount other elements that can be secured at an upper surface of the printed circuit board. Accordingly, the mobile terminal can be produced with a slimmer profile than devices with similar parts known heretofore.

Further, by mounting a high band antenna at the side surface 14 of the printed circuit board 13, the overlapping on a Z-axis with an antenna of another band that would be unavailable in an existing conventional carrier type antenna is available. Therefore, a mounting space of a radiator within the mobile terminal can be secured. The antenna of another band is a low band antenna mounted on an upper surface of the printed circuit board 13.

The second and third internal antennas 30 and 40 may be mounted according to several types of mounting methods at the side surfaces 14 and 15 of the printed circuit board 13.

Hereinafter, a method of mounting the second and third internal antennas 30 and 40 at the side surfaces 14 and 15 of the printed circuit board 13 is described in detail with reference to FIGS. 3, 4, 5 6 and 7.

FIG. 3 is a perspective view illustrating a process of mounting an internal antenna of the mobile terminal of FIG. 2.

First, according to this example, the second internal antenna 30 and the third internal antenna 40 are a plurality of internal antennas for mounting at the side surfaces 14 and 15 of the printed circuit board 13 and are separated and mounted by a predetermined gap of a range that hardly has an influence on respective signals and antenna gains.

Referring now to FIG. 3, a side surface of the printed circuit board 13 may be formed in a shape having a predetermined slope or the printed circuit board can be formed with a flat shape.

In the present exemplary embodiment, at the side surface 14 of the printed circuit board 13 having a predetermined slop, the second internal antenna 30 is mounted, and at the side surface 15 of the printed circuit board 13 separated by a predetermined gap from the second internal antenna 30 and having a flat side surface, the third internal antenna 40 is mounted. Furthermore, as the side surface 14 of the printed circuit board 13, the side surface 14 adjacent to the boss hole 6 (best seen in FIG. 1) is described as an exemplary embodiment.

With reference to FIG. 3, in order to fasten one end 32 of the second internal antenna 30 to the printed circuit board 13, the printed circuit board 13 may include at least one fastening opening H1 at the inside.

Further, the printed circuit board 13 may have, for example, a fixed area P corresponding to each of the other end 34 and an intermediate end 33 of the second internal antenna 30. A fixed area P corresponding to the intermediate end 33 is positioned at a rear surface of the printed circuit board 13, and a fixed area P corresponding to the other end 34 is positioned at a front surface of the printed circuit board 13. The fixed area P may be fixed to the other end 34 and the intermediate end 33 of the second antenna 30 through, for example, soldering.

The second internal antenna 30 may be formed into a body 31 extended in a lengthwise direction of the second internal antenna 30, one end 32, which is one of the end portions of the second internal antenna 30, and the other end 34, which is an end portion in a direction opposite to one end 32, and the intermediate end 33 that corresponds to a central area of the one end 32 and the other end 34 (i.e. first and second ends).

The body 31 has a structure extended in a lengthwise direction of the second internal antenna 30 and contacts along the side surface 14 of the printed circuit board 13. In this case, the body 31 is over-bent further than a slope angle of the side surface 14 and thus the side surface 14 of the printed circuit board 13 naturally fixes a pattern of the body 31. In other words, the body 31 has a bent pattern according to a slope degree of the side surface 14. As shown in FIG. 3, a thickness "a" of the body 31 is the same as a thickness "b" of the printed circuit board 13.

One (first) end 32, the intermediate end 33, and the other (second) end 34 have a structure that protrudes in a predetermined direction from the body 31 of the second internal antenna 30. A predetermined direction in which the one (first) end 32, the intermediate end 33, and the other (second) end 34 protrude is determined as a direction that contacts with a portion of a front surface and a rear surface of the printed circuit board 13 when installed.

When the body 31 contacts with the side surface 14 of the printed circuit board 13, the protruded one (first) end 32 and other (second) end 34 may be provided in a structure that covers a portion of a front surface of the corresponding printed circuit board 13, and the protruded intermediate end 33 may be provided in a structure that covers a portion of a rear surface of the corresponding printed circuit board 13. Simultaneously, the other end 34 may be soldered at a front surface of the printed circuit board 13, and the intermediate end 33 may be soldered at a rear surface of the printed circuit board 13.

Here, because a vertical distance between the other (second) end 34 and the intermediate end 33 is formed in the same length as a thickness of the side surface 14 of the printed circuit board 13, when the body 31 contacts with the side surface 14, the second antenna 30 is inserted into the printed circuit board 13.

Figure 4:
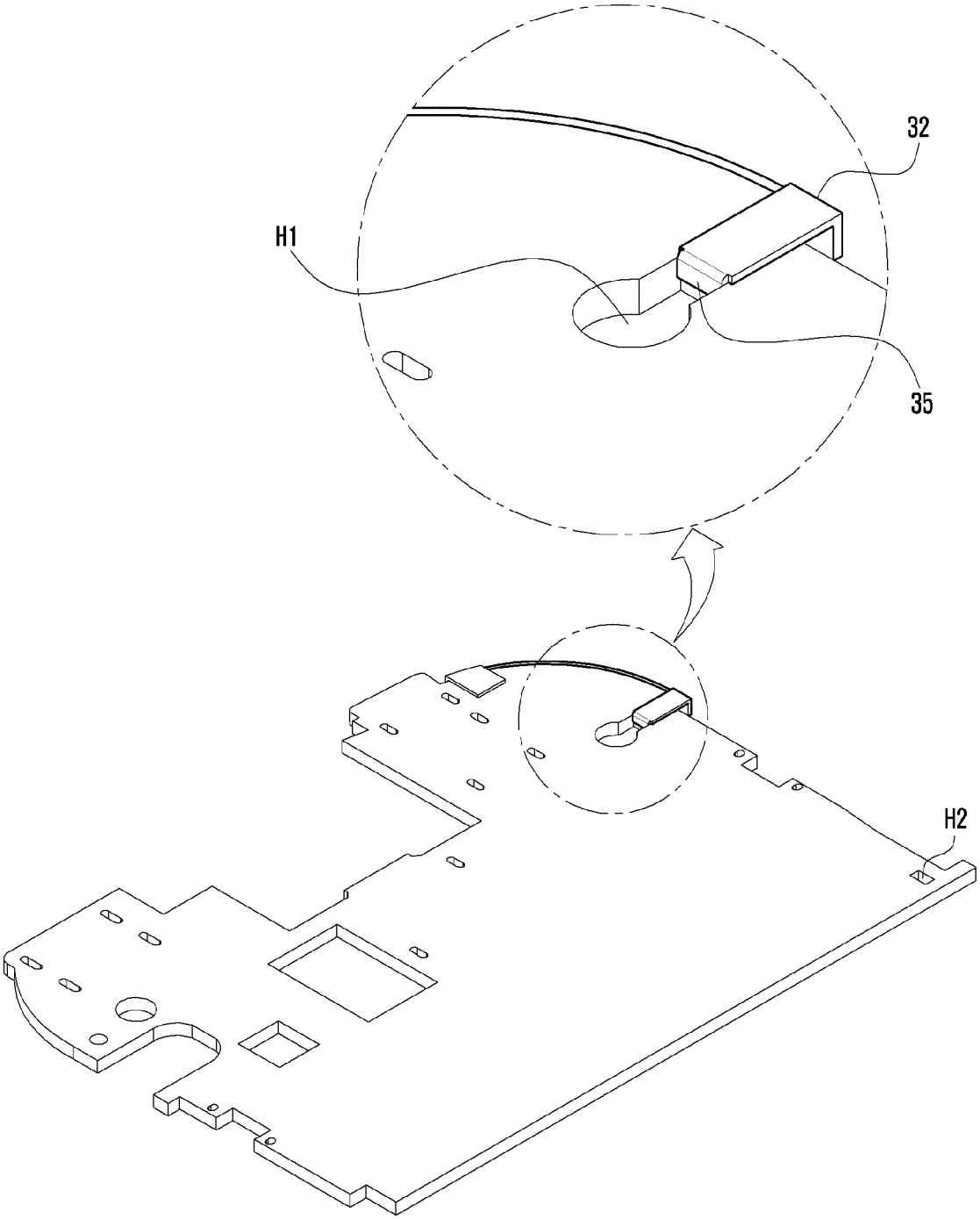
FIG. 4 is a perspective view illustrating a portion of a structure in which an antenna shown in FIG. 3 is fastened.

FIG. 4 is a perspective view illustrating a portion of a structure in which an antenna is fastened according to an exemplary embodiment of the present invention.

Referring now to FIG. 4, particularly, one (first) end 32 includes a fixing protruded portion 35 in which an end portion that is fastened to the printed circuit board 13 is bent in a direction of a fastening opening H1. The fixing protruded portion 35 has a structure latched to an internal wall of the fastening opening H1 and is latched and fastened to the printed circuit board 13.

The fixing protruded portion 35 is formed in the same height as or a height smaller than a thickness "b" of the printed circuit board 13 to be latched to the fastening opening H1. Because a thickness of the printed circuit board is generally 0.5 mm to 1.6 mm a height of the fixing protruded portion 35 may be formed in 0.5 mm to 1.6 mm.

Particularly, when the side surface 14 of the printed circuit board 13 is adjacent to the boss hole 6, the boss hole 6 may be used as the fastening opening H1. In order to fasten the front cover 1 and the rear cover 2, the boss hole 6 is formed in the printed circuit board 13. By using the boss hole 6 instead of the fastening opening H1 for fixing the second antenna 30 to the printed circuit board 13, it is unnecessary to further form an additional hole in the printed circuit board 13 and thus a process may be simplified. Thus, in such a case the fastening opening H1 can be considered optional.

In the mobile terminal according to the present exemplary embodiment, by inserting the second internal antenna 30 into the printed circuit board 13 through the intermediate end 33 and the other(second) end 34 and by soldering and fastening the intermediate end 33 and the other (second) end 34 to the printed circuit board 13, and latching and fastening by the fixing protruded portion 35 may be performed and thus coherence between the second internal antenna 30 and the printed circuit board 13 may be further improved.

The second internal antenna 30 may be made of a conductive metal material, for example, steel use stainless (SUS) having tension upon over-bending. However, any substance that can be used as an antenna is also within the spirit and scope of the appended claims.

Figure 5:
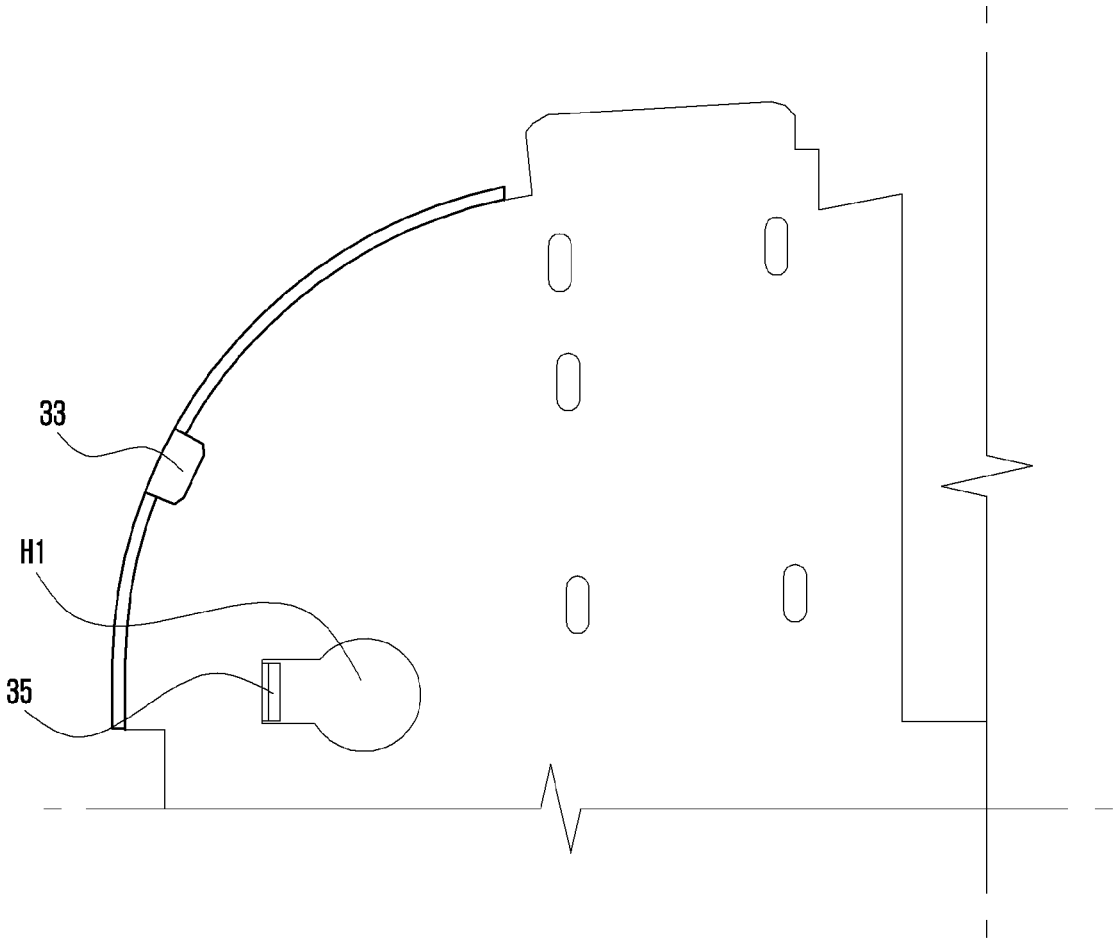
FIG. 5 is a cross-sectional view illustrating a rear surface of a printed circuit board in which an antenna shown in FIG. 3 is mounted within the mobile terminal of FIG. 2.

FIG. 5 is a cross-sectional view illustrating a rear surface of the printed circuit board in which an internal antenna of the mobile terminal of FIG. 2 is mounted.

Referring now to FIG. 5, the intermediate end 33 of the second internal antenna 30 makes contact with a rear surface of the printed circuit board 13 and is attached to the rear surface of the printed circuit board 13 by soldering. Further, the fixing protruded portion 35 is fastened to the fastening opening H1.

Figure 6:
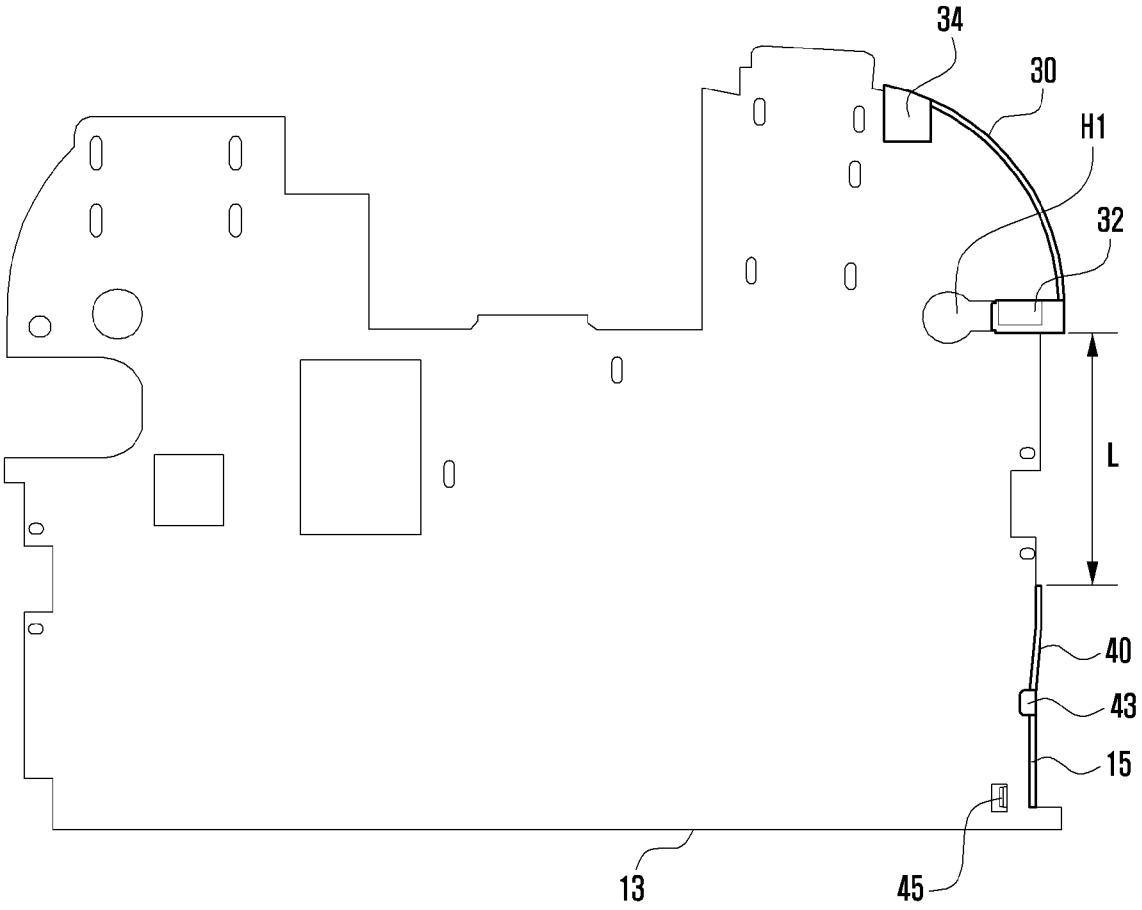
FIG. 6 is a cross-sectional view illustrating a front surface of a printed circuit board in which an antenna of FIG. 3 is mounted within the mobile terminal of FIG. 2.

FIG. 6 is a cross-sectional view illustrating a front surface of the printed circuit board 13 in which an internal antenna of the mobile terminal of FIG. 2 is mounted.

Referring now to FIG. 6, the second internal antenna 30 and the third internal antenna 40 may be separately disposed by a predetermined gap "L" within a range that does not have an influence on respective signals or antenna gains.

The third internal antenna 40 is preferably mounted at the flat side surface 15 of the printed circuit board 13, and a mounting method thereof is almost the same as that of the second internal antenna 30 and therefore a description of the mounting method identical to or corresponding to that of the second internal antenna 30 is omitted.

However, when the side surface 15 of the printed circuit board that is used to mount the third internal antenna 40 thereon is not adjacent to the boss hole 6, a new hole H2 may be previously formed at the inside of the printed circuit board 13 and protruded one (first) end 42 of the second internal antenna 30 may be fastened to the new hole H2.

Further, one (first) end 32, the intermediate end 33, and the other (second) end 34 of the second internal antenna 30 are formed to close contact with a front surface and a rear surface of the printed circuit board 13, but one end 42 and the other end 44 of the third internal antenna 40 are formed to contact with a rear surface of the printed circuit board 13, and an intermediate end 43 thereof is also formed to contact with a front surface of the printed circuit board 13.

Further, in the present exemplary embodiment, the second and third internal antennas 30 and 40 are mounted only to one side surface of the printed circuit board 13, but in consideration of a structure relationship and an influence with mounted other elements, mounting of the second and third internal antennas 30 and 40 may be applied to entire side surfaces of the printed circuit board 13.

Further, in the present exemplary embodiment, as an internal antenna that mounts to one of the side surfaces 14 and 15 of the printed circuit board 13, the respective second and third internal antennas 30 and 40 are described, but in consideration of a structure relationship and an influence with other elements, the number of internal antennas that may be mounted is limited.

Further, the present exemplary embodiment can be applied even to a sub-printed circuit board disposed at a lower end portion of the mobile terminal as well as the printed circuit board disposed at an upper end portion of the mobile terminal.

In order to widen a surface area, the side surfaces 14 and 15 of the printed circuit board 13 according to the present exemplary embodiment may be formed in a structure having a plurality of flexures or unevenness. By forming the side surface 14 of the printed circuit board 13 in a plurality of flexures or unevenness structure, a surface area may be enlarged, and thus a length of the second internal antenna 30 contact can be extended.

Accordingly, in a mobile terminal having a plurality of internal antennas according to the present exemplary embodiment, by fixing the first internal antenna 20 using tension occurring when contacting the first internal antenna 20 with an inclined side surface 14 of the printed circuit board, the plurality internal antennas can be prevented from moving or separating without using a separate device for fixing the internal antennas.

Furthermore, by forming the optional fastening opening H1 within the printed circuit board 13, by fastening the fixing protruded portion 35 of the internal antennas in a latch structure at an internal wall of the fastening opening H1, and by simultaneously fixing a portion 23 of the antenna to the printed circuit board by soldering, the internal antennas can be prevented from moving or separating.

As described above, in a mobile terminal having a plurality of internal antennas according to the present invention, by fastening one end of one of the internal antennas using an existing boss hole within a printed circuit board, the internal antennas can be mounted without using a separate deice for fixing the internal antennas, and by simplifying a process, a cost can be reduced and reliability of a product can be improved.

Further, in a mobile terminal that should support a multi-band and a multi-function, by mounting some of the antennas along a side surface of the printed circuit board based on size, mounting space of the internal antennas can be secured, space to mount other elements on the printed circuit board can be secured, and the mobile terminal can be produced in a reduced thickness than known heretofore.

Further, by soldering and fixing a protruded portion of the internal antennas to enclose a front surface and a rear surface of the printed circuit board, coherence is strengthened and thus the internal antennas can be prevented from moving and separating.

Further, by mounting a plurality of internal antennas in an upper end portion of the mobile terminal to the maximum, when holding the mobile terminal with a hand, an area in which a mounted portion of an antenna radiator covered by the hand is reduced, and an influence caused by the hand is minimized. Therefore, an antenna performance can be improved.

The above-described embodiments according to the present invention can be implemented in hardware, firmware or via execution of software or computer code loaded into hardware for execution, and which is stored on a non-transitory machine readable medium such as a CD ROM, a RAM, a floppy disk, a hard disk, or a magneto-optical disk or computer code downloaded over a network originally stored on a remote recording medium or a non-transitory machine readable medium and stored on a local non-transitory recording medium, so that the methods described herein are loaded into hardware such as a general purpose computer, or a special processor or in programmable or dedicated hardware, such as an ASIC or FPGA. As would be understood in the art, the computer, the processor, microprocessor controller or the programmable hardware include memory components, e.g., RAM, ROM, Flash, etc. that may store or receive software or computer code that when accessed and executed by the computer, processor or hardware implement the processing methods described herein. In addition, it would be recognized that when a general purpose computer accesses code for implementing the processing shown herein, the execution of the code transforms the general purpose computer into a special purpose computer for executing the processing shown herein. In addition, an artisan understands and appreciates that a "processor" or "microprocessor" constitute hardware in the claimed invention. Under the broadest reasonable interpretation, the appended claims constitute statutory subject matter in compliance with 35 U.S.C. §101 and none of the elements consist of software per se.

The terms "unit" or "module" as may be used herein is to be understood as constituting hardware such as a processor or microprocessor configured for a certain desired functionality in accordance with statutory subject matter under 35 U.S.C. §101 and does not constitute software per se.

Although exemplary embodiments of the present invention have been described in detail hereinabove, it should be clearly understood that many variations and modifications of the basic inventive concepts herein described, which may appear to those skilled in the art, will still fall within the spirit of the invention and the scope of the appended claims.

What is claimed is:

1. A mobile terminal having a plurality of internal antennas and a printed circuit board disposed between a front cover and a rear cover, the mobile terminal comprising:

the printed circuit board having at least first internal antenna mounted on an upper surface of the printed circuit board, and the print circuit board having at least one fastening opening therein; and a second internal antenna mounted in an upper portion of a side surface of the printed circuit board and comprising a protruded portion of a first end protruding from a body of the second internal antenna and in which the protruded portion is fastened to an edge of the fastening opening to fasten the body of the second internal antenna to the side surface of the printed circuit board, wherein the protruded portion of the second internal antenna further includes an intermediate end, and a second end of the body in which each of the intermediate end and second end protrude from the body of the second internal antenna, the first end arranged fastened to an edge of the fastening opening, and the intermediate end and the second end are in contact with a portion of the upper surface or a rear surface of the printed circuit board to fasten the body of the second internal antenna to the side surface of the printed circuit board.

2. The mobile terminal of claim 1, wherein the fastening opening comprises a boss hole formed in the printed circuit board in der to fasten the front cover and the rear cover to the printed circuit board.

3. The mobile terminal of claim 1, wherein the intermediate end and the second end of the second internal antenna are soldered to a rear surface and a front surface, respectively, of the printed circuit board.

4. The mobile terminal of claim 1, wherein the second internal antenna comprises at least one of a Bluetooth (BT) antenna, global positioning system (GPS) antenna, and Wi-Fi antenna, and the first antenna is at least one of a global system for mobile communications (GSM) antenna, code division multiple access (CDMA) antenna, wideband code division multiple access (WCDMA), or diversity antenna.

5. The mobile terminal of claim 1, wherein the second internal antenna is overlapped with the first internal antenna formed at an upper surface of the printed circuit board on a vertical-axis.

6. The mobile terminal of claim 1, wherein a surface of the printed circuit board in which the second internal antenna contacts the side surface of the printed circuit board has a plurality of flexures.

7. The mobile terminal of claim 1, wherein the second internal antenna is over-bent further than a slope angle of inclination of the printed circuit board for fixing the second internal antenna to the side surface of the printed circuit board.

8. The mobile terminal of claim 1, wherein the second internal antenna is comprised of a conductive metal material that is bent cause a tension attachment upon the printed circuit board.

9. The mobile terminal of claim 7, wherein the second internal antenna comprises steel use stainless (SUS).

10. The mobile terminal of claim 1, wherein the second internal antenna is separated from the first internal antenna by a predetermined gap and mounted at the side surface of the printed circuit board.

11. The mobile terminal of claim 1, further comprising a third internal antenna arranged along the side surface of the printed circuit board.

12. The mobile terminal of claim 11, wherein the third internal antenna is arranged away from the second internal antenna by a predetermined gap at the side surface of the printed circuit board.

13. An internal antenna arrangement of a mobile terminal in which a printed circuit board having at least one fastening opening at an inside and having a plurality of internal antennas comprising a first antenna disposed at an upper surface of the printed circuit board, the internal antenna arrangement comprising:

a second internal antenna for that is in contact with a side surface of the printed circuit board and having a body with a first end latched to an internal wall of a fastening opening and having a frequency band higher than a frequency of the first antenna, wherein the second internal antenna comprises:

the body is curved according to a slope of the printed circuit board and contacting with the side surface of the printed circuit board;

the first end of the body having a fixing protruded portion having an end portion bent into a fastening opening of a direction of the printed circuit board for latching to the internal wall of the fastening opening;

a second end of the body positioned in a direction opposite to the first end and contacting with a front surface of the printed circuit board; and an intermediate end of the body being positioned at a central area of the first end and the second end and contacting with a rear surface of the printed circuit board, wherein the first end, the intermediate end, and the second end of the body protrude in a predetermined direction from the body.

14. The internal antenna arrangement of claim 13, wherein a surface of the printed circuit board in which the second antenna make contacts with has a plurality of flexures.

15. The internal antenna arrangement of claim 13, wherein the mobile terminal comprises a main circuit board in an upper end portion and a sub-circuit board in a lower end portion of the printed circuit board, and the printed circuit board is disposed at the upper end portion of the mobile terminal.

16. The internal antenna arrangement of claim 13, further comprising a third internal antenna arranged along the side surface of the printed circuit board.

17. The internal antenna arrangement of claim 16, wherein the third internal antenna is arranged away from the second internal antenna by a predetermined gap at the side surface of the printed circuit board.

18. The internal antenna arrangement of claim 17, wherein the both the second internal antenna and the third internal antenna each have a frequency band that is higher than a frequency band of the first antenna.

* * * * *